US005295861A

United States Patent [19]

Peretick et al.

[11] Patent Number: 5,295,861

[45] Date of Patent: Mar. 22, 1994

[54] CONNECTOR FOR IGNITION COIL ASSEMBLY

[75] Inventors: James Peretick, Saline; Vincent J. DeSantis, Northville, both of Mich.

[73] Assignee: Ford Motor Company, Dearborn, Mich.

[21] Appl. No.: 71,217

[22] Filed: Jun. 2, 1993

Related U.S. Application Data

[63] Continuation of Ser. No. 811,856, Dec. 23, 1991, abandoned.

[51] Int. Cl.[5] ..... H01R 13/60

[52] U.S. Cl. ..... 439/527; 123/647

[58] Field of Search ..... 123/634, 647; 439/527, 439/436

[56] References Cited

U.S. PATENT DOCUMENTS

| | | | |
|---|---|---|---|
| 2,447,376 | 5/1943 | Tognola . | |
| 3,141,923 | 9/1962 | Henschke et al. . | |
| 3,864,002 | 2/1975 | Naser et al. . | |
| 4,763,094 | 8/1988 | Kojima . | |
| 4,849,728 | 7/1989 | Goll et al. . | |
| 4,962,361 | 10/1990 | Ida . | |
| 5,044,328 | 9/1991 | Umezaki | 123/647 |

FOREIGN PATENT DOCUMENTS

| | | |
|---|---|---|
| 0253939 | 11/1986 | European Pat. Off. . |
| 0395511 | 4/1990 | European Pat. Off. . |
| 0395513 | 4/1990 | European Pat. Off. . |
| 2199700 | 12/1986 | United Kingdom . |

*Primary Examiner*—Eugene F. Desmond

*Attorney, Agent, or Firm*—Richard D. Dixon; Roger L. May

[57] ABSTRACT

An electrical connector, suitable for use in coupling an engine ignition coil encased by potting material within an electrically insulated housing, includes a distended section for extending into the potting material adjacent to the coil, and an external coupler for engaging with an electrical connector from the vehicle ignition system. A central mounting section between these two end sections of the connector includes a U-shaped section defining a slot therein which couples with and communicates over a lip of the housing at a level above the potting material in order to reduce leakage of the potting material during the high temperature curing process. The central mounting section and the housing also include cooperating channels and ridges for guiding electrical conductors that couple with and then restrict the movement of the ignition coil within the housing.

14 Claims, 4 Drawing Sheets

CONNECTOR FOR IGNITION COIL ASSEMBLY

This is a continuation application of Ser. No. 07/811,856 filed on Dec. 23, 1991, now abandoned.

TECHNICAL FIELD

This invention relates to a connector of the type used in an ignition coil assembly for internal combustion engines.

This invention is related to the inventor's commonly-assigned and copending application Ser. No. 07/812,419 entitled "IGNITION COIL ASSEMBLY AND METHOD OF MANUFACTURE THEREOF" as filed on Dec. 23, 1991.

BACKGROUND ART

Current conventional ignition coil assemblies for internal combustion engines, in particular those for vehicular applications, include a sizeable steel laminated core and associated primary and secondary coil assemblies encased within a fairly thin electrically insulating thermoplastic housing. With reference to FIGS. 4 and 4A, an electrical connector 200 connected to the primary coil protrudes through a slot adjacent the upper rim of the housing. Since the lower edges of the slot and the connector are below the level of the potting material 98 filling the interior cavity of the housing, a generally U-shaped grommet 202 made of a pliable rubber is used to seal the interface between the connector 200 and the housing 204.

Correctly assembling the housing, the connector and the grommet during a high volume, high speed production process not only requires the extensive use of manual labor but often results in an improperly seated connector. This can result in a void adjacent the grommet that allows the heated potting material to drain out of the housing during the curing process.

The present invention is directed to resolving these concerns, while maintaining an efficiency and reliability of design that will minimize the use of manual labor and the critical nature of the rubber grommet to housing and/or connector seal.

SUMMARY OF THE INVENTION

In view of the foregoing, this invention contemplates providing a connector for an ignition coil assembly having increased overall ease of assembly and reliability by reducing the possibility of potting material draining from the housing during the curing process, which could allow water ingress to the internal components of the ignition coil.

The connector body is formed from an electrically insulating material, and includes a section external to the housing and an internal section for extending at least partially below the surface of the potting material. A generally U-shaped mounting section is included between the internal and external sections of the connector for traversing over and engaging with a lip section of the ignition coil housing at a position above the level of the potting material. Conductors communicate through the external, U-shaped mounting and internal sections of the connector body for electrically coupling to the ignition coil within the housing. The mounting section and the housing also include cooperating channels and ridges for guiding the conductors as they couple with and then restrict the movement of the ignition coil within the housing.

The foregoing and other features and advantages of the present invention are readily apparent from the following detailed description of the best mode for carrying out the invention when taken in conjunction with the accompanying drawings.

BEST MODE FOR CARRYING OUT THE INVENTION

Figure 1:
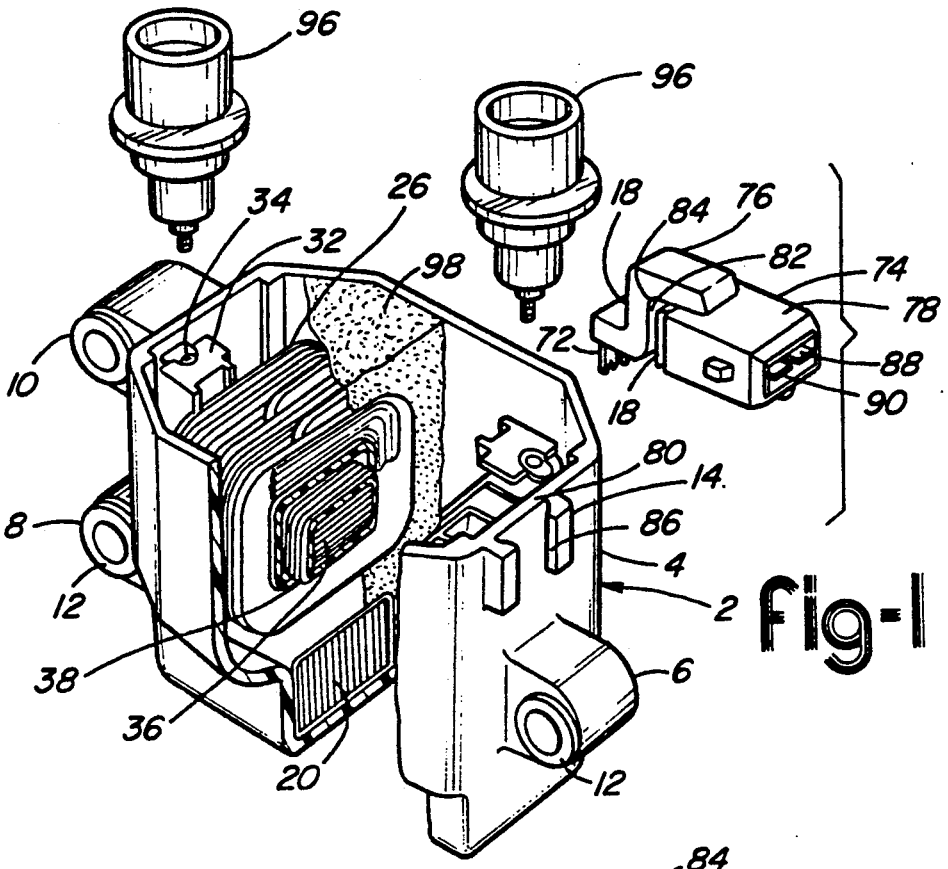
FIG. 1 is a perspective, partially sectioned, partially exploded view of an ignition coil assembly according to one embodiment of the invention.
Figure 2:
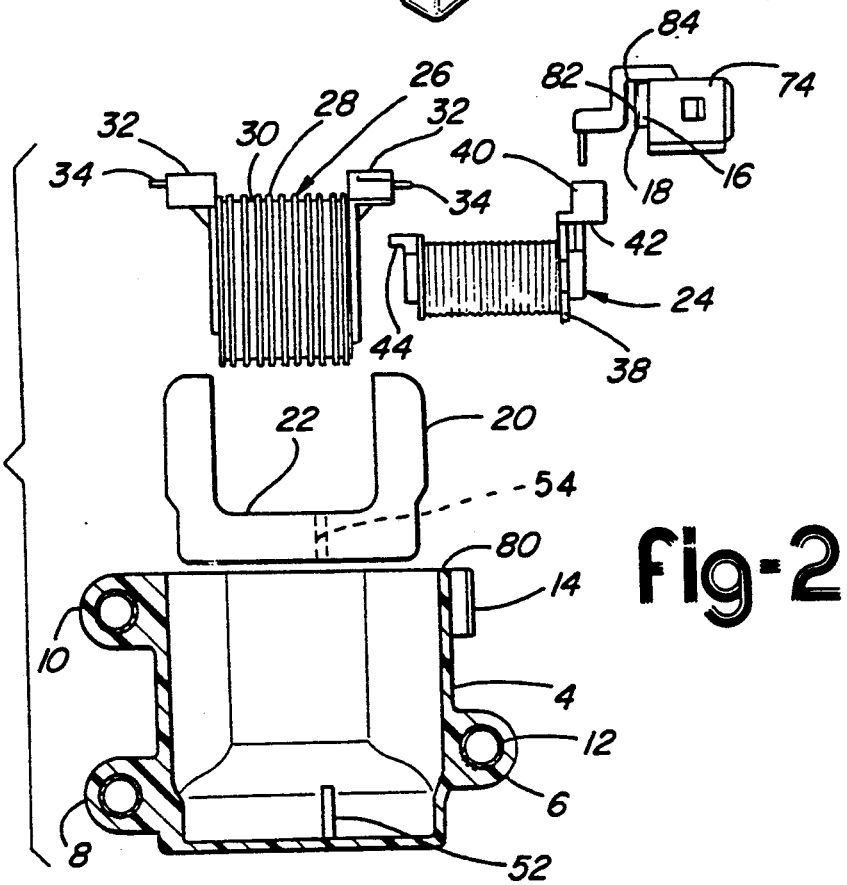
FIG. 2 is a side, partially sectioned, exploded view of the ignition coil assembly shown in FIG. 1 and with potting material and high voltage towers removed.
Figure 3:
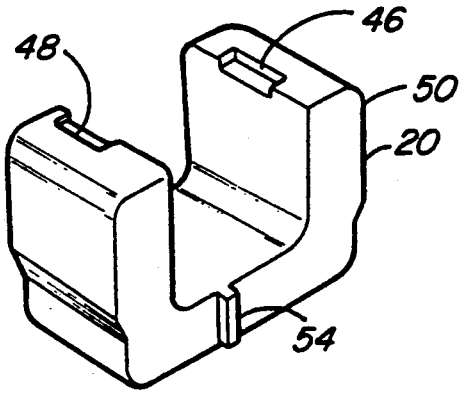
FIG. 3 is a perspective view of a C-shaped laminated core totally encased in a rubber insulation material according to the embodiment shown in FIGS. 1 and 2.
Figure 4:
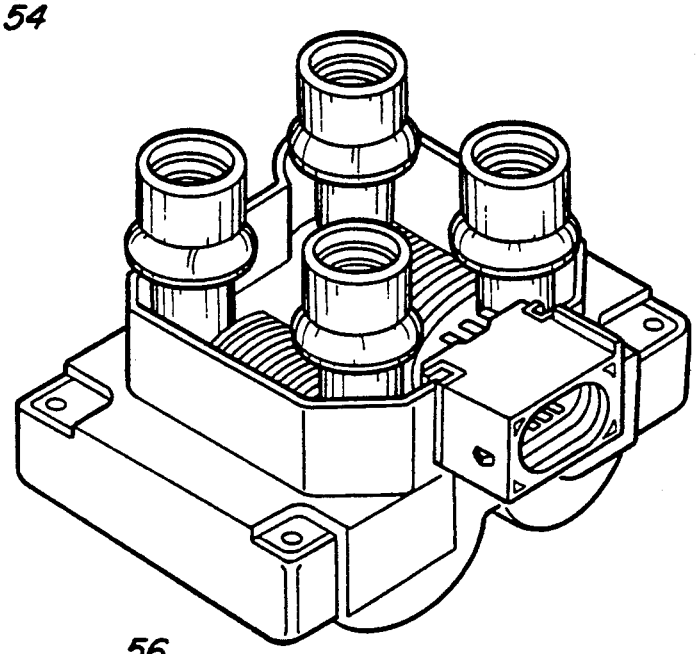
Fig-4 PRIOR ART
FIG. 4 is a perspective view of a four tower ignition coil assembly of the prior art.

Referring now to FIGS. 1, 2 and 3, an ignition coil assembly 2 of the present invention includes a housing 4 having a plurality of identical mounting members 6, 8 and 10 all disposed on the exterior of the housing and molded integrally with the housing. Elongated metal bushings 12 are positioned within the center of the mounting members to facilitate secure mounting of the ignition coil assembly within the engine compartment.

A dovetail receiving section 14 is also integrally molded onto the outside of the housing. The dovetail receiving section 14 securely receives and holds in place a corresponding dovetail locking section 16 configured on the primary connector assembly. The legs or ridges 18 on each side of locking section 16 are in a tight, slip fit engagement with and within the respective channels of the receiving section 14.

A steel laminated C-shaped core 20 is located within the housing. Core 20 is provided with an inner open cavity 22 within which is nested primary and secondary coil assemblies designated 24 and 26, respectively. The secondary coil assembly 26 includes bobbin 28. A coil 30 is wound around bobbin 28 with the ends of the coil terminating at the secondary terminal boxes 32. The secondary coil end portions are soldered to the secondary terminals 34 which are press fit into the secondary terminal boxes 32.

Figure 5:
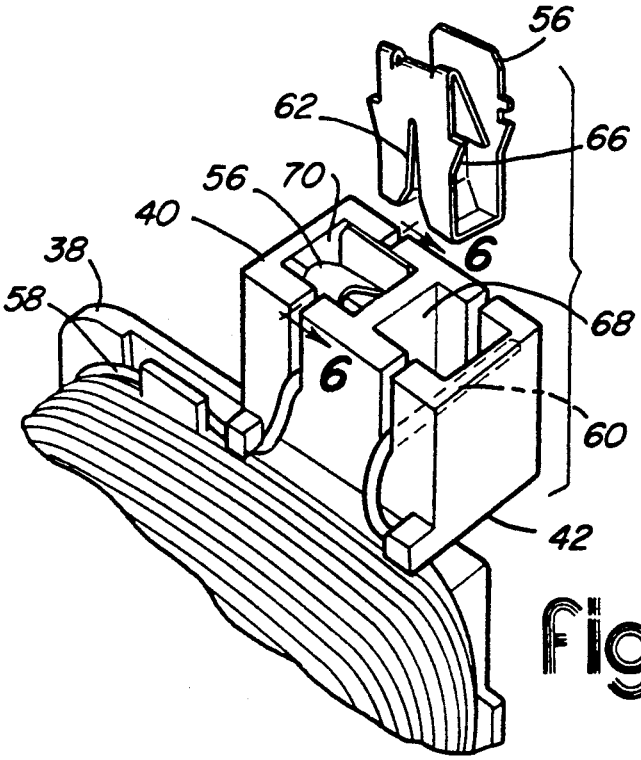
FIG. 5 is an enlarged, perspective, partially exploded view of the primary bobbin, primary coil, primary terminals and primary terminal receptacle of the present invention as shown in FIG. 1.

Referring now to FIGS. 1, 2 and 5, the primary coil assembly 24 is seen to comprise a laminated I-shaped core 36 molded within a bobbin 38. A primary terminal receptacle 40 is an integrally molded part of the bobbin 38 at one end thereof and includes a terminal seat portion 42. A second seat 44 extends from the bobbin 38 at its other end. Each seat 42,44 is adapted to mate with a first inner recess 46 and second inner recess 48, respectively, formed on the core 20 as shown in FIG. 3.

For assembly purposes, to assure the coil assembly is oriented properly within the case, the seats 42,44 are laterally offset from one another as are the recesses 46,48. Thus, each functions as a piece orientation feature just as the key and keyway 52,54, respectively of the core and housing, as explained in detail below.

FIG. 3 shows a laminated C-shaped core 20 encased in a rubber modified polypropylene shell 50. The C-shaped laminated core is adapted to be received and slip fit inside the lower portion of the housing. The rubber modified polypropylene 50 such as sold by A. Schulman, Inc. (USA) under the trademark Polytrope® (specification Nos. TPP 503, 504, 514, 517 and 524) and also sold by Advanced Elastomeric Systems (USA) under the trademark Santoprene® and Vistaflex® (TPR), specification Nos. 123-60 and 9203-54W900, respectively, is a preferred encasement material because it acts as a compliant, compressible, stress-relief layer between the metal C-core 20 and the housing 4. The surface chemistry of the encasement material must be non-bonding or non-reactive with the housing and potting material to allow for movement of the materials with respect to one another as well as provide relief from the effects of differing coefficients of expansion of the various materials. This non-bonding chemistry prevents cracking during thermal cycling or during extended time periods at elevated temperatures that ignition coil assemblies are commonly subject to.

A keyway 52 is positioned inside an inner portion of the housing 4 and mateable key 54 is provided on the outside portion of the core and adapted to engage the keyway 52 of the housing 4.

Figure 6:
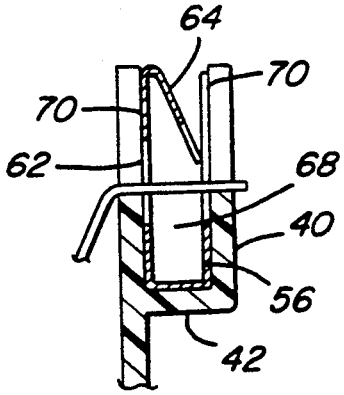
FIG. 6 is a sectioned side view taken along lines 6—6 of FIG. 5 and illustrating the insulation displacement terminal and a portion of the primary coil inserted within.
Figure 4A:
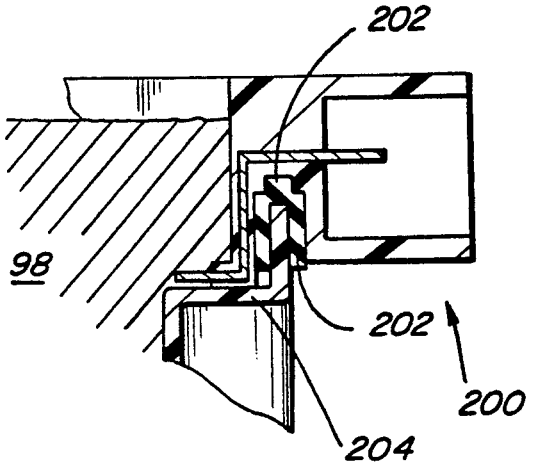
Fig-4A PRIOR ART
FIG. 4A is a cross-sectional view taken along the center line of the prior art connector penetrating through the housing as shown in FIG. 4.

As shown in FIGS. 5 and 6, the primary bobbin 38 also has disposed above the primary terminal seat 42 a primary terminal receptacle 40 which is configured to receive a pair of insulation displacement terminals 56. A coil 58 is wound around the bobbin 38 with the terminating ends 60 of the coil 58 placed within the insulation displacement terminals 56 and confined within pairs of oppositely disposed, inverted V-shaped slots 62.

The terminating ends 60 of the primary coil 58 thus extend the length of the cavity within which the displacement terminal resides. The terminals 56 are U-shaped and include a spring biasing arm 64 which engages the leads 60. The terminals 56 are held in the cavity by burrs 66 on the sides of the terminals 56. Thus when the insulation displacement terminals 56 are positioned inside the primary terminal receptacle cavity 68, the terminal will be wedged in place against the side walls 68 of the cavity. Each insulation displacement terminal 56 includes inverted V-shaped slots 62 or coil receiving openings such that when the terminal is forced down into cavity 70 the primary coil terminating ends 60 will be engaged.

As shown in FIG. 6, the primary coil terminating ends 60 extend through both the primary terminal receptacle 40 and the insulation displacement terminals 56. As the coil receiving opening 62 is brought down upon the primary coil end portion 60, the insulation material deposited entirely along on the primary coil 58 is shaved off and direct electrical contact is made between the primary coil terminating ends 60 and the insulation displacement terminal 56.

Figure 8A:
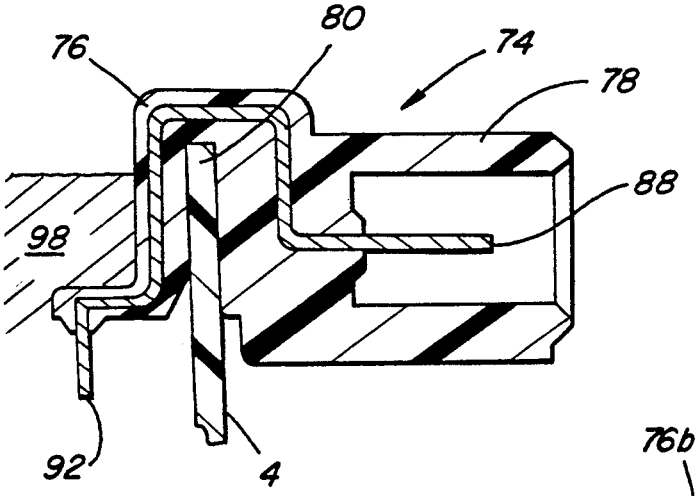
FIGS. 8A and 8B are cross-sectioned views taken along the center line of the connector in FIG. 8 as attached to the rim of the housing and then exploded away from the rim of the housing in order to reveal internal surfaces.
Figure 8B:
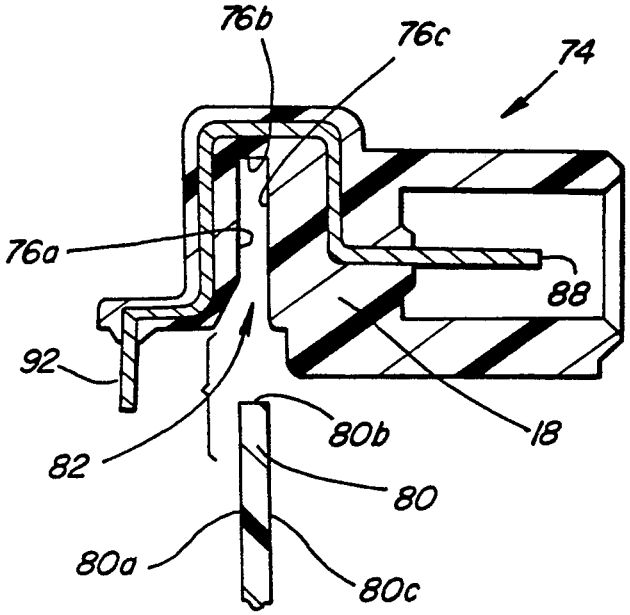
Figure 7:
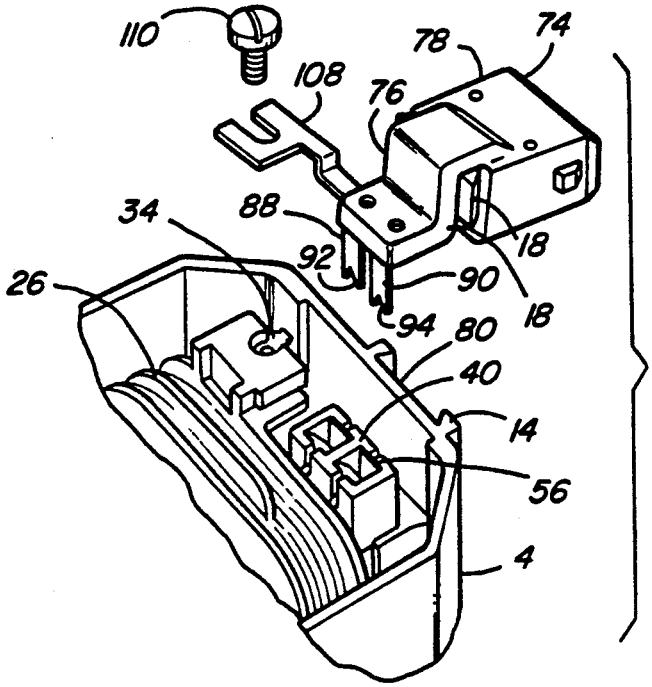
FIG. 7 is a perspective, exploded view of an alternative embodiment of the present invention showing a primary connector assembly and a bypass electrical connection utilized in a distributor-type ignition coil assembly.
Figure 8:
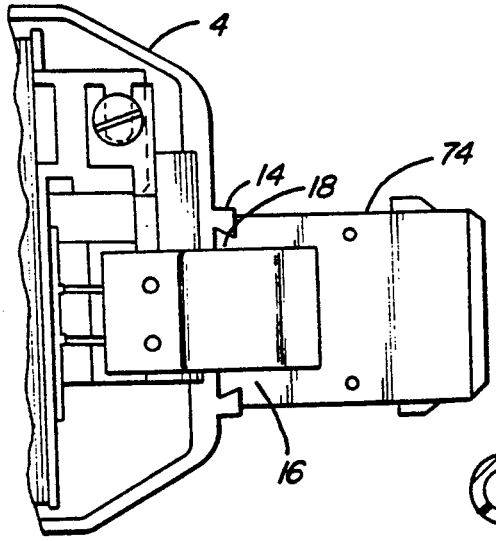
FIG. 8 is a segmented top view of an alternative embodiment of the primary connector assembly illustrating a bypass electrical connection and the dovetail locking and receiving sections.

The primary connector assembly 74 as shown in FIGS. 1 and 2 and again in FIGS. 7 and 8 is made of an electrically insulating material. It has an electrode insulation segment 76 and a receptacle portion 78. With additional reference to FIGS. 8A and 8B, electrode insulation segment 76 is constructed to overlap a lip or rim portion 80 of the housing 4 and extend down into the cavity defined by the housing. Leg 18 is spaced from the receptacle portion 78 to provide a gap or slot 82, shown best in FIG. 8B, slightly greater in width than the thickness of the thin lip of the housing such that the connector assembly will slip over the lips 80 until it engages the connector assembly at the bend 84. More specifically, inside surface 76*a* is drawn tightly against adjacent section 80*a* of the lip 80 so as to prevent the invasion, by capillary action or otherwise, of the heated potting material therebetween when the internal void defined within the housing 4 is encapsulated and subjected to a high temperature curing process.

In a similar manner, inside surface 76*b* defining the rectangular cavity for receiving lip 80 is drawn tightly against the upper surface 80*b* thereof so as to prevent the invasion by capillary action of the heated potting material when the housing 4 is cured. Likewise, inside surface 76*c* of the connector is drawn tightly against outside surface 80*c* of the lip 80 by the action of the dovetail receiving section 14 and the dovetail locking section 16 as shown best in FIGS. 7 and 8. Whereas the gap 82 retains the assembly 74 from outward separation from the housing, the locking section 14 and channel members 86 preclude relative lateral displacement.

As shown in FIG. 7, electrical leads 88 and 90 travel through the electrode insulation segment 76 and the receptacle portion 78. The electrical leads 88, 90 have at their end portions, openings 92, 94 which facilitate a direct electrical connection between the end portion of the electrical leads 88, 90 and the primary coil 58.

As shown in FIGS. 2, 7 and 8, the electrical leads 90 and 88 insert into and are compressed by the spring biasing arms 64 of the terminals 56, which are held within the receptacle cavities 68 and 70 of the primary terminal receptacle 40 as shown in FIG. 6. In this manner the rigid mechanical coupling between the dovetail receiving and locking sections 14 and 16 is transferred through the connector assembly 74 and the conductors 88, 90 to hold the primary coil assembly 24 within the secondary coil assembly 26, and to align the secondary coil assembly 26 within the gap of the C-shaped core 20.

As is conventional, lead 88 receives ignition system control data from an onboard ignition control system and secondary primary connector assembly electrical lead 90 receives 12 volt input from the vehicle battery systems.

To assemble the coil assembly 2, the primary coil assembly 24 is inserted within secondary coil assembly 26. Separately the core 20 is inserted within housing 4. Then the combined coil assembly 24, 26 is placed within the cavity 22 of core 20 such that primary terminal seats 42 and extension seat 44 of the primary bobbin 28 rest within recesses 46 and 48, respectively, of C-shaped core 20. The secondary coil assembly 26 and the primary coil assembly 24 are thus supported within the inner open cavity 22 of the C-shaped laminated core 20.

The dovetail receiving and locking sections 14, 16 guide the electrical leads 88, 90 into the terminals 56 as the connector assembly 74 is attached to the housing.

Towers 96 are then threaded into secondary terminals 34. The molding or potting resin 98 (typically a dielectric epoxy compound such as EP697F Resin manufactured by THERMOSET Plastics of Indianapolis, Ind.) is subsequently introduced into the inner portion of the housing after all components have been assembled and the molding resin covers and electrically insulates the entire ignition coil assembly. Several hours of high temperature curing are typically required to set the potting material.

FIGS. 7 and 8 are examples of an alternative embodiment of the present invention adapting an ignition coil assembly suitable for use with a distributorless ignition system to an ignition coil assembly suitable for use with a distributor-based ignition system. Removal of one high voltage tower 96 and the addition of a slightly modified primary connector assembly effectively transforms the ignition coil assembly to a distributor type coil for use in a conventional internal combustion engine. Specifically, the modified primary connector assembly of this embodiment utilizes a bypass member 108 which connects the secondary terminal 34 to the second electrical lead 88 which is the positive terminal of the primary coil. Electrical lead 88 is at low voltage, i.e., 12 volts for the conventional 12 volt system, and thus provides a virtual ground. Fastening screw 110 secures bypass electrical connection 108 to terminal 34.

Figure 9:
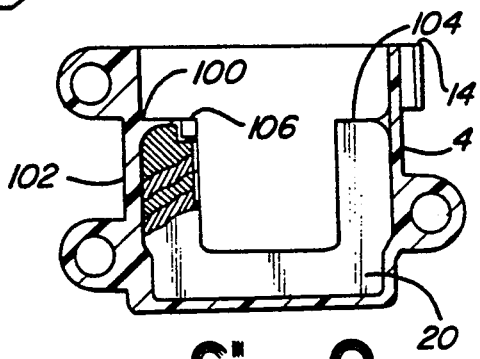
FIG. 9 shows an alternative embodiment of the present invention in partial cross-section wherein the core is molded within the coil assembly housing.

FIG. 9 shows a further embodiment of the present invention wherein the core 20 is molded entirely within the inner and outer walls 100,102 of the housing. The core 20 entirely encased within the housing is provided with a first inner recess 104 and a second inner recess 106 adapted to mate with the terminal seat portion 42 and the second seat 44 of the bobbin 38. The corresponding position of the inner recesses is identical to that shown in FIG. 3. Alternatively, a rubber coated core, not shown, may be inserted molded between the inner and outer walls of the assembly housing 2.

While the best mode for carrying out the invention has been described in detail, those familiar with the art to which this invention relates will recognize various alternative designs and embodiments for practicing the invention as defined by the following claims.

We claim:

1. A connector suitable for use in connecting with an electrical component located within an open cavity defined by a housing which is filled with a potting material, comprising:

a body formed from an electrically insulating material, including, external means for extending external to the housing, internal means for extending at least partially below the surface of the potting material, mounting means, coupling between said internal means and said external means, including a generally U-shaped section for engaging with and for traversing over a lip section of the housing which is above the level of the potting material, said mounting means and the housing also including therein cooperating channels and ridges for restricting the relative motion of the connector with respect to the housing; and conductor means, communicating through said U-shaped section of said mounting means and said internal means, for electrically coupling to and for being guided by said mounting means into mechanical coupling with the electrical component within the housing.

2. The connector assembly according to claim 1 wherein said external means includes connector means for mechanically mating with a connector external to the housing.

3. The connector assembly according to claim 1 wherein said mounting means includes a first surface juxtaposed with an inner surface of the housing adjacent the lip closely enough so as to prevent the escape by capillary action of the potting material from the housing as the potting material cures.

4. The connector assembly according to claim 3 wherein said first surface of said mounting means conforms closely with the inner surface of the housing to provide support generally perpendicular to said first surface.

5. The connector assembly according to claim 1 wherein said mounting means includes a second surface supported by an outer surface of the housing for coupling the connector to the housing.

6. The connector assembly according to claim 1 wherein said ridges and channels of said mounting means are positioned for fixing the position of the component within the cavity defined by the housing.

7. The connector assembly according to claim 1 wherein said mounting means includes dovetail ridges and the housing includes dovetail channels.

8. A connector suitable for use in connecting an automotive electronic system with an ignition coil carried within a cavity defined by a housing which is filled with a potting material, comprising:

a body formed from an electrically insulating material, including, an external section located external to the potting material, a distended section extending at least partially below the surface of the potting material, mounting means, coupled between said distended section and said external section, including a generally U-shaped section having a slot therein for engaging with and for traversing over a lip section of the housing above the level of the potting material, said mounting means and the housing also including therein cooperating ridges and channels for guiding the relative motion between the connector and the housing; and conductor means extending from a portion of said external section below the level of the potting material, through said mounting means adjacent said slot, and through said distended section for operatively coupling to the ignition coil within the housing.

9. The connector assembly according to claim 8 wherein said U-shaped section includes a first surface juxtaposed with an inner surface of the housing closely enough so as to prevent the escape by capillary action of the potting material therebetween as it cures.

10. The connector assembly according to claim 9 wherein said first surface of said U-shaped section conforms closely with the inner surface of the housing to provide support generally perpendicular to said first surface.

11. The connector assembly according to claim 10 wherein said U-shaped section also includes a second surface supported by an outer surface of the housing for coupling the connector to the housing.

12. The connector assembly according to claim 9 wherein said external section also includes connector means for mechanically mating with a connector external to the housing.

13. The connector assembly according to claim 12 wherein said ridges and channels of said mounting means guide the coupling motion of said conductor means as it engages with the ignition coil within the cavity defined by the housing.

14. The connector assembly according to claim 8 wherein said mounting means includes dovetail ridges for coupling within dovetail channels in the housing for guiding the relative motion between the connector and the housing.

* * * * *